United States Patent [19]

Thumser

[11] Patent Number: 4,735,332

[45] Date of Patent: Apr. 5, 1988

[54] CLEANING-PAIL ATTACHMENT

[75] Inventor: Udo Thumser, Baldham, Fed. Rep. of Germany

[73] Assignee: Firma Carl Freudenberg, Weinheim/Bergstr., Fed. Rep. of Germany

[21] Appl. No.: 914,300

[22] Filed: Oct. 2, 1986

Related U.S. Application Data

[63] Continuation of Ser. No. 688,167, Dec. 31, 1984, abandoned.

[30] Foreign Application Priority Data

Jun. 7, 1984 [DE] Fed. Rep. of Germany ..... 3421147

[51] Int. Cl.[4] ..... A47I 13/58

[52] U.S. Cl. ..... 220/85 R; 24/526; 15/260; 15/263

[58] Field of Search ..... 220/85 R, 90, 90.4; 15/257 R, 260, 263; 24/530, 536, 545, 547, 561, 562, 526

[56] References Cited

U.S. PATENT DOCUMENTS

| | | | |
|---|---|---|---|
| 1,627,383 | 5/1927 | Gothberg | 15/263 |
| 1,918,986 | 7/1933 | Schulman | 15/263 |
| 2,674,391 | 4/1954 | Davis | 220/90 |
| 3,962,758 | 6/1976 | Knappe et al. | 24/526 |

FOREIGN PATENT DOCUMENTS

| | | | |
|---|---|---|---|
| 2036622 | 3/1979 | Fed. Rep. of Germany | 15/260 |
| 755605 | 9/1933 | France | 15/263 |
| 1467872 | 12/1966 | France | 15/260 |
| 24976 | of 1909 | United Kingdom | 15/263 |
| 259379 | 10/1926 | United Kingdom | 15/263 |

*Primary Examiner*—Steven M. Pollard
*Attorney, Agent, or Firm*—Felfe & Lynch

[57] ABSTRACT

A cleaning-pail attachment for the removal of excess moisture from a mop which comprises a downwardly tapering hollow strainer with three mounting claws for its attachment over the mouth of a cleaning pail, and wherein the mounting claws are fastened to the hollow strainer on opposite sides, substantially normal thereto, and provided with downwardly open slots extending in the peripheral direction for being set onto the upper rim of the cleaning pail, the slots being bounded on one side by a support strap and on the other side by a spring tongue. The support strap and the spring tongue are preferably provided at their lower end with a projection which narrows the slot, and preferably are of resilient construction in the direction of said projection.

4 Claims, 1 Drawing Sheet

CLEANING-PAIL ATTACHMENT

Figure 1:
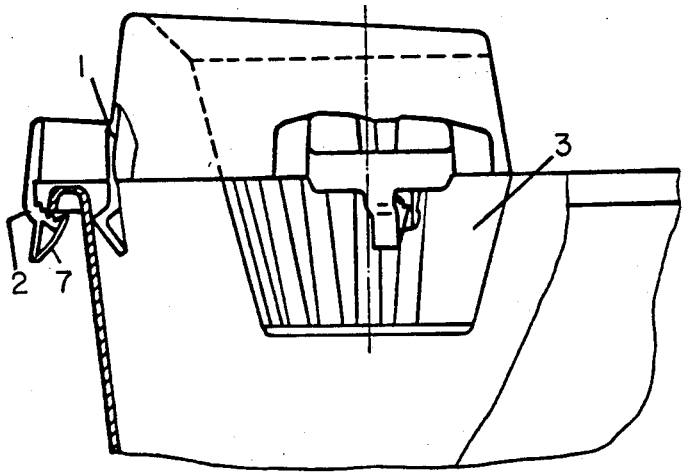

This is a continuation application of application Ser. No. 688,167 filed Dec. 31, 1984, now abandoned.

This invention relates to a cleaning-pail attachment for the removal of excess liquid from a mop which preferably comprises a downwardly tapering hollow strainer with three mounting claws for its attachment over the mouth of a cleaning pail, and wherein preferably two of the mounting claws are fastened to the hollow strainer on opposite sides and the third mounting claw is fastened to the hollow strainer between the two opposite mounting claws, the mounting claws preferably extending from the hollow strainer substantially normal thereto, and the mounting claws being provided with downwardly open slots extending in the peripheral direction for being set onto the upper rim of the cleaning pail.

A cleaning-pail attachment of this type is on the market. It can only be used in combination with a specially adapted cleaning pail, which is regarded as a serious drawback both in its sale and in its practical use. Besides, such an attachment cannot be secured positively enough to the upper rim of a cleaning pail, and it can also be impaired by wear. Thus it does not fulfill its intended function, which is the removal of excess liquid from a mop.

Mops are used for the large-area damp cleaning of floor coverings and are customary in the United States and in southern countries, for example. A mop usually consists of a plurality of absorbent strips which are gathered together in the manner of a tassel and fastened to the end of a long handle. Collectively, the strips have a large surface area. When moist, they are therefore able to pick up large amounts of dirt from the floor and thus make for fast work. However, this requires that the strips be dipped in water and thoroughly rinsed at intervals during mopping, and that the excess liquid then be removed from them. This is usually done by introducing the strips which are bunched in the manner of a tassel collectively into the downwardly tapering hollow strainer disposed above the water level, after they have been dipped into the water contained in the pail, and pressing them by turning and pressing down on the handle. The excess water runs back into the pail through the apertures in the strainer, and the mop then is ready for further use. Such handling, however, requires that the cleaning-pail attachment be firmly secured. Yet it is precisely in this respect that the attachments known up to now leave much to be desired.

The invention has as an object to provide a cleaning-pail attachment for the use described which with its hollow strainer can readily and firmly be secured over the mouth of commonly used cleaning pails without the use of tools, and which can be just as readily removed after use.

In accordance with the invention, this object is accomplished in that in a cleaning-pail attachment of the type described at the outset the slots in the mounting claws are bounded on one side by a support strap and on the other side by a spring tongue. The support strap is preferably disposed on the inside, and the spring tongue on the outside. The mounting claws of the proposed cleaning-pail attachment thus clasp the upper rim of the pail with initial tension effective in the radial direction. The cleaning-pail attachment thus is at all times positively secured to the upper rim of the cleaning pail, the specific design of the upper rim and/or the diameter of the cleaning pail used being of no consequence so far as such securing is concerned. Even wear will not impair such securing and operation.

The support straps and/or the spring tongues may be provided at their lower end with at least one projection which juts out into the clearance of the slot. This will result in more effective clasping of the upper rim, which in the commonly used cleaning pails usually has an external bead, and hence in improved securing of the cleaning-pail attachment.

The slots in the three mounting claws may be increasingly narrowed downwardly in proximity to the projections, advantageously in a steadily increasing manner. In such an embodiment, the individual projections are bounded at the top by inclined planes which project into the slot in a wedgelike manner. When the spring tongues are provided with corresponding projections, it will be advisable to make their dimension in the vertical direction such that the lower terminal edge of the bead on the rim of the commonly used cleaning pails is overlapped on both sides. Securing will pose no appreciable difficulties since the usual tolerance is only about 10 mm.

When the inclined plane of the spring tongue and the lower terminal edge of the beaded rim of the cleaning pail are pressed together, the cleaning-pail attachment is securely locked in position, especially when the inclined plane makes a relatively small angle with the horizontal. With respect to such locking in position, it should be borne in mind, however, that decreasing angles require an increasing deflection of the spring tongue as the attachment is set onto the pail. This may result in high specific loading of its material of construction, which in turn may lead to rather unappealing designs when the cleaning-pail attachment is made of a thermoplastic material, for example. Embodiments in which the inclined plane makes an angle of between 30 and 60 degrees with the horizontal are therefore preferred. They will permit physically attractive one-piece construction of the entire cleaning-pail attachment by the use of thermoplastic materials such as polyvinyl chloride or polypropylene.

Locking between the inclined plane and the lower terminal edge of the bead on the upper rim of the pail, as described above, can be improved further by providing the inclined plane on the side facing the edge with grooving extending in the peripheral direction. The individual grooves are then advantageously bounded by flanking surfaces extending in the horizontal and vertical directions so that, depending on the type and size of the cleaning pail used, one of the grooves of each projection embraces the aforesaid edge at all times in the vertical direction from below and externally. The interlocking and operative engagement between the cleaning-pail attachment and the upper rim of the cleaning pail is thus further improved.

In a further advantageous embodiment, both the support strap and the spring tongue are provided with at least one projection and the slot is narrowed in substantially symmetrical fashion by the two projections. No tilting moments of any kind will thus be encountered as the cleaning-pail attachment is pressed onto the upper rim of the cleaning pail. Both the mounting and the removal of the cleaning-pail attachment are considerably facilitated thereby.

Mounting of the cleaning-pail attachment on the cleaning pail is facilitated further when the support straps and/or the spring tongues are extended downwardly beyond the projections and especially in that area are given the shape of rearward wedges. The slot is thus widened in a wedge-like manner in proximity to the extension, which makes it much easier to introduce the upper rim of the pail in the slot. The maximum width of the slot in that area is greater than the maximum width of the upper rim of the commonly used cleaning pails. Mounting of the attachment then merely requires that it be vertically pressed onto the upper rim of the pail.

To facilitate the removal of the cleaning-pail attachment, it has been found advisable that the wedgelike enlargement of the spring tongue be bounded at its lower end by a gripping strip. Advantageous is a keylike design which permits the spring tongues of the opposed mounting claws to be released simultaneously with both hands so that the cleaning-pail attachment can be tilted backward over the third mounting claw. Thus the removal of the cleaning-pail attachment is also very simple.

In a further advantageous embodiment, the support strap is also made resilient in the direction of the slot, in addition to the spring tongue. The adaptability of the attachment to differently shaped rims of the commonly used cleaning pails is improved thereby, and at the same time particularly firm seating is achieved.

The support straps and/or the spring tongues advantageously are of very small width in the peripheral direction. The width should not be greater than the radial dimension of the upper rim of the commonly used cleaning pails to provide assurance that firm seating will always be achieved, regardless of the size of a particular cleaning pail.

In accordance with the invention, a cleaning-pail attachment for the removal of excess liquid from a mop, comprises a hollow strainer including a plurality of mounting means for its attachment over the mouth of a cleaning pail. Two of the mounting means extend from the hollow strainer on opposite sides and a third mounting means extends from the hollow strainer between the two opposite mounting means. The mounting means have downwardly open slots extending in the peripheral direction for being set onto the rim of the cleaning pail. Each of the mounting means also comprises a support strap bounding one side of one of the slots and a spring tongue bounding the other side of the aforesaid one of the slots.

For a better understanding of the present invention, together with other and further objects thereof, reference is made to the following description, taken in connection with the accompanying drawing, and its scope will be pointed out in the appended claims.

Figure 2:
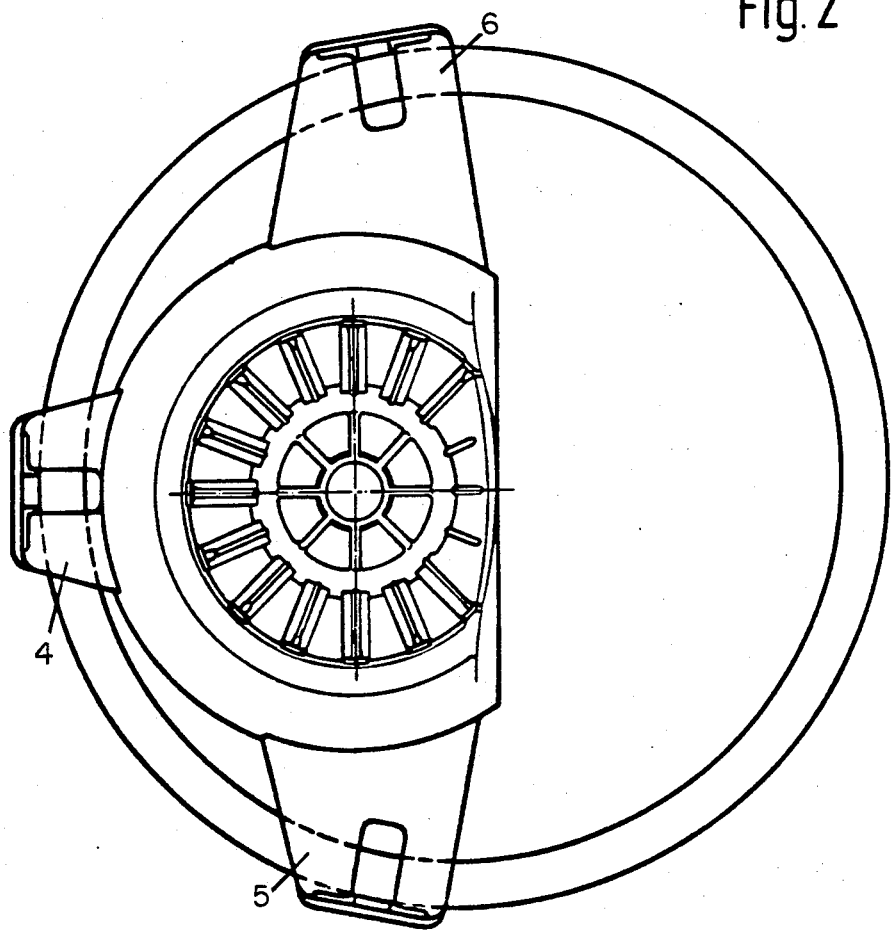

Referring now to the drawing:

FIG. 1 is a fragmentary sectional view of a cleaning pail with a cleaning-pail attachment mounted on its upper rim, and FIG. 2 is a top plan view of a cleaning-pail attachment mounted on the upper rim of a cleaning pail.

The cleaning-pail attachment shown in FIGS. 1 and 2 preferably is a one-piece molded polyvinyl chloride part which can be securely mounted on the upper rim of cleaning pails of all conventional sizes simply by being set thereon. To this end, the cleaning-pail attachment preferably comprises three mounting claws 4, 5 and 6 which are provided on their underside with a slot that extends in the peripheral direction of the cleaning pail and fits over its rim. A flat mounting surface preferably is superposed on the rim and then preferably is level with it when the attachment is set onto the cleaning pail with the mounting claws 4, 5 and 6 extending from the hollow strainer 3 substantially normal thereto.

In the radial direction, the rim of the cleaning pail preferably is clasped externally by a spring tongue 2 and internally by a support strap 1. Both preferably are resilient in the manner of a spring in the radial direction and preferably are provided with opposed projections which constrict the slot in a wedgelike manner at a narrowed point. The cleaning-pail attachment thus can readily be pushed onto the upper rim of the cleaning pail, where it is automatically positioned and the slots in the three mounting claws are elastically widened. The projections disposed on the spring tongues 2 finally snap in under the terminal edge of the bead which externally bounds the cleaning pail. They preferably are formed by inclined planes provided with grooving which extends in the peripheral direction. The reciprocal engagement between cleaning-pail attachment and cleaning pail thus is extremely stable. It will readily withstand the application of fairly large forces. Removal of the cleaning-pail attachment from the cleaning pail merely requires that the spring tongues 2 of the opposed mounting claws 5 and 6 be released simultaneously with both hands and that the attachment then be tilted backward over the mounting claw 4 and the outer edge of the rim of the cleaning pail. For this purpose, the spring tongues 2 are provided with gripping strips 7. These can readily be actuated with a finger much like a key.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. A cleaning-pail attachment for the removal of excess liquid from a mop, comprising:

a hollow strainer including a plurality of similar fixedly positioned mounting means for its attachment over the mouth of a cleaning pail, two of said mounting means extending from said hollow strainer on opposite sides and a third of said mounting means extending from said hollow strainer between said two opposite mounting means, and said mounting means having downwardly open slots extending in the peripheral direction for being set onto the upper rim of the cleaning pail, each of said mounting means also comprising a support strap bounding one side of one of said slots and a spring tongue bounding the other side of said one of said slots, each of said support straps and each of said spring tongues having at its lower end at least one projection which juts into the slot whereby said slot is narrowed downwardly in a steadily increasing manner by said projections, said at least one projection of each of said spring tongues having grooves in the peripheral direction to aid in gripping the pail rim, the dimension of each of said support straps and each of said spring tongues in the peripheral direction being not appreciably greater than the radial width of the rim of the cleaning pail.

2. Cleaning-pail attachment as claimed in claim 1 wherein said support straps and the spring tongues have guide means extending downwardly beyond said projections for facilitating the mounting of the attachment onto the cleaning pail.

3. Cleaning-pail attachment as claimed in claim 1 wherein the guide means comprise two members extending from said spring tongue and support strap, respectively, which members slant backward from the clearance between said projections of said spring tongue and support strap.

4. Cleaning-pail attachment as claimed in claim 1 wherein said guide means members are substantially wedge-shaped to form a substantially downwardly enlarged wedge-shaped opening therebetween.

* * * * *